United States Patent [19]

Pacansky et al.

[11] 4,077,324

[45] Mar. 7, 1978

[54] METHOD OF FOUNTAINLESS LITHOGRAPHY

[75] Inventors: Thomas J. Pacansky, Penfield, N.Y.; James H. Becker, Denton, Tex.

[73] Assignee: Xerox Corporation, Stamford, Conn.

[21] Appl. No.: 657,505

[22] Filed: Feb. 12, 1976

Related U.S. Application Data

[62] Division of Ser. No. 485,404, Jul. 3, 1974.

[51] Int. Cl.[2] ..... B41M 1/06; B41M 1/14

[52] U.S. Cl. ..... 101/450; 96/29 L; 101/462; 101/465

[58] Field of Search ..... 96/1.8, 33, 29 L; 101/450, 452, 453, 457, 462, 465; 428/29, 409, 913

[56] References Cited

U.S. PATENT DOCUMENTS

| | | | |
|---|---|---|---|
| 3,209,683 | 10/1965 | Greubel | 96/33 |
| 3,608,483 | 9/1971 | Kaminstein | 101/452 |
| 3,620,812 | 11/1971 | Boutle et al. | 428/913 |
| 3,677,178 | 7/1972 | Gipe | 96/33 |
| 3,844,994 | 10/1974 | Vijayendran | 101/465 |
| 3,901,700 | 8/1975 | Yoerger et al. | 96/33 |

*Primary Examiner*—John H. Newsome

*Attorney, Agent, or Firm*—James J. Ralabate; James P. O'Sullivan; Donald M. MacKay

[57] ABSTRACT

A method of producing a lithographic printing master, novel masters and a method of printing therefrom are provided which obviate the need for an aqueous fountain solution. The process for printing comprises applying an ink and a solvent (which may or may not be in the ink) to an imaged master and transferring the resultant developed image to a receiver member. The nonimaged portions of said master are formed of an ink releasing solvent swellable elastomer selected from organohydrocarbon backbone polymers (which may or may not contain hetero atoms), copolymers and mixtures. The solvent is a fluid capable of swelling the nonimaged areas of said elastomer but not capable of dissolving the elastomeric imaged master. The solvent is added in an amount to diffuse into the nonimaged areas of the imaged master and form a substantially ink-free layer on the nonimaged areas of the master during inking and transferring of the inked image.

21 Claims, No Drawings

METHOD OF FOUNTAINLESS LITHOGRAPHY

This is a division of application Ser. No. 485,404, filed July 3, 1974.

BACKGROUND OF THE INVENTION

In conventional lithography, an aqueous fountain solution is employed to prevent the printing ink from wetting the non-image areas of the planographic plate.

It has recently been discovered that the requirement for a fountain solution can be obviated, by employing a planographic plate having a silicone elastomeric layer. Because ink releases from the silicone under printing conditions, no fountain solution is required.

BRIEF DESCRIPTION OF THE INVENTION

It has now been discovered that other materials can be made ink releasing such that they can be employed in the nonimaged areas of a planographic plate to obviate the need for a fountain solution. More particularly, it has been discovered that polymers having an organohydrocarbon backbone (which may or may not contain hetero atoms) copolymers and mixtures, can be made ink releasing, by applying to the background a diffusable solvent in an amount sufficient to form a substantially pigment free layer in the nonimaged areas of the master during inking and transferring of the inked image. By employing a solvent which is capable of swelling the nonimaged areas of the master but not capable of dissolving the elastomeric master, it is possible to employ materials other than silicone elastomers in the master's nonimaged areas and still print therefrom without need for a fountain solution. In addition, it has been discovered that the solvent can be applied from the lithographic ink or be incorporated into the nonimaged master substrate. In addition, the conventional lithographic inks can be employed when they contain a suitable diffusable solvent and a binder resin as hereinafter described. While not intended to be bound by any theory, it is believed that the diffusable solvent applied to the master substrate provides a cohesively weak boundary layer or lubricated boundary layer such that ordinary ink accepting polymers are made ink releasing. Consequently, a considerably greater number of materials can be employed as the master substrate than the polydimethylsiloxane elastomer previously employed in fountainless or waterless lithography.

The novel waterless lithographic printing masters of the invention comprise a substrate having ink receptive imaged areas and ink releasing nonimaged areas wherein said nonimaged areas are formed by a solvent swellable elastomer layer selected from an organohydrocarbon backbone polymer, (which may or may not contain hetero atoms such as chlorine, nitrogen, phosphorus, oxygen, sulfur, bromine and fluorine with the halogen atoms only in a side chain), copolymers and mixtures. The method of preparing the printing master comprises coating a suitable substrate with one of the aforementioned materials; and forming an ink accepting image pattern thereon. The method of printing comprises the additional steps of applying a solvent and an ink, or an ink containing a solvent to said imaged master and transferring the inked image to a receiving member by direct or offset printing.

DETAILED DESCRIPTION OF THE INVENTION

Typical materials, which include the types of master materials, inks, and solvents which can be employed, as well as a method for selecting these materials, is herein discussed in detail.

While the swellable solvent can be supplied separately from the ink, in order to simplify the printing procedure it is preferred that the solvent be supplied as a part of the ink vehicle and thus the disclosure will be described as such although it is not to be so limited.

Commercial printing inks comprise at least a pigment, a binder resin or polymer (and other solid matter) and a vehicle or volatile solvent as the major components. While there are many ingredients in a commercial ink, for the purposes of this invention, only the aforesaid three components of the ink are necessary for adhesion and release. The pigment, such as for example carbon black, serves to make the image visible and transfer the image. The resin or polymer binder serves as a carrier for the pigment, and as a binder agent for the pigment to the transfer surface. The vehicle or volatile solvent gives the ink its fluid character, carries the other components in dissolved or dispersed phase through the printing process, and through absorption on or evaporation from, aides the setting characteristics for the ink.

It was experimentally found that certain relationships must exist between the materials employed. The nonimage areas or background areas of the master must (1) not dissolve in the ink solvent, (2) they must allow diffusion of the ink solvent and thus be swellable by the ink solvent and (3) no absorption or appreciable adsorption of ink polymer into or onto the non-image surface must occur. Further, with regard to the image areas (1) they must not dissolve in the ink solvent, (2) they must not allow appreciable diffusion of ink solvent into the image surface, and (3) they must be firmly adhered to the master. Finally, the ink must (1) contain a solvent that can diffuse into the master in the nonimage areas, (2) contain an ink polymer (to include other solid matter in the ink) which does not adhere, absorb or appreciably adsorb onto the non-image areas of the master, (3) where there is selective absorption or adsorption the ink polymer (plus pigment) should be selectively absorbed or adsorbed to the image in preference to the ink solvent, and (4) the ink polymer must be at least partially soluble in the ink solvent.

It has been found that the solubility parameter concept provides a convenient method for selecting materials. The solubility parameter ($\delta$) for solvents is determined from its vapor pressure and solubility parameters for various solvents are given in the literature (K. L. Hoy, Journal of Paint Technology, Volume 42, No. 541, February, 1970, pages 91–102, which are herein incorporated by reference). Solubility parameters for polymers are conveniently determined from solvents in which they are soluble or swellable. A solvent which dissolves or swells the polymer the most will have approximately the same solubility parameter as the polymer. By weighing the polymer both before and after swelling, it can be determined how much solvent was absorbed. Solubility parameters for common polymers are given in the literature (J. Brandrup, E. H. Immergut, Polymer Handbook, Interscience Publishers John Wiley and Son, New York, 1967, Pages IV-362–368). They can be experimentally determined by the method of Burrell (Interchemical Review, Spring 1955, Pages 8–16) which is herein incorporated by reference. The solubility parameter of a material is determined under thermodynamic conditions and cannot predict kinetic phenomena (i.e., rates of diffusion). Since the solubility parameter deals only with enthalpic considerations, solubility by chemical reaction, exothermic solubility, the solubility of crystalline materials and non-solubility (or non-diffusion) due to entropic exclusion cannot be accurately predicted. The solubility parameter system can be used with confidence for predicting the solubility (extent of diffusion) or non-solubility of amorphous materials (crosslinked or not crosslinked) which are solubilized (swelled) by dispersion or polar forces. For crystalline materials the solubility parameter system can be used to describe non-solvents. (In addition, the absolute amounts of diffusion are dependent on the degree of crosslinking in the case of polymers, concentration of solvent in the ink, molar volume of the solvent, and other factors.)

As a general rule the following relationships can be expressed from the solubility parameters. Whenever the statement is made that the solubility parameter of one material must differ (or be similar) from that of another material, the number 2 is used as the limit. This number is somewhat arbitrary, but based on our experience with this concept, it is the general limit of solubility of most polymers. For the background or non-image areas of the master, the solubility parameter of the background and the solubility parameter of the ink solvent must be close to allow for diffusion of ink solvent into the background. The difference of the two solubility parameters should be less than about $2(cal/cm^3)^{\frac{1}{2}}$. Further the solubility parameter of the background and the solubility parameter of the ink polymer should be different, preferably $2(cal/cm^3)^{\frac{1}{2}}$. For non-crystalline images the solubility parameter of the image must be different from the solubility parameter of the ink solvent to minimize ink solvent diffusion or solubility [ $2(cal/cm^3)^{\frac{1}{2}}$]. For crystalline images, the solubility parameter may not be important for solvent diffusion and solubility. For optimum adhesion between the master material and the image area, the solubility parameter ($\delta$) for the coating forming the background areas of the master should differ from the solubility parameter ($\delta$) of the ink solvent by a greater amount than the difference between the solubility parameter of the image areas of the master and the solubility parameter of the master material, that is:

$$(\delta master - \delta ink\ solvent) > (\delta image - \delta master).$$

The solubility parameter criteria expressed above for amorphous polymer images is thus inconsistent for good image adhesion. Consequently, it is preferred for amorphous images to chemically combine the imaging material and master, physically entrap the imaging material in the master, or print from an underlying substrate. Further, the ink polymer should have a solubility parameter different from the solubility parameter of the background by a greater amount than the solubility parameter of the ink solvent is different from the solubility parameter of the background $$(\delta ink\ polymer) - (\delta background) > (\delta ink\ solvent - \delta background).$$

Finally the solubility parameter of the ink polymer should be different from but close to the solubility parameter of the ink solvent [i.e. differing by $2(cal/cm^3)^{\frac{1}{2}}$].

Accordingly, we have found that a large number of mterials can be used in this printing process providing the materials and their interactions meet the criteria set out above.

By utilizing the aforesaid principles and solubility parameters, printing systems were devised for materials having low, medium and high solubility parameters, which are listed in the following Table I.

TABLE I

TYPICAL PRINTING SYSTEMS FOR WATERLESS LITHOGRAPHY

| MASTER(NON-IMAGE)δ | INK POLYMER δ | INK SOLVENT δ | IMAGE δ |
|---|---|---|---|
| LOW SOLUBILITY PARAMETER | | | |
| 1. Poly(ethylene-co-propylene) 8–10 | 1.1 poly(methylacrylate) 10–11 | 1.1 butyl benzoate 9.5 | 1.1 poly(acrylonitrile) 12–13 |
| (Nordel 1470,Dupont) | 1.2 Celulose diacetate 10–11 | 1.2 tetrahydronaphthalene 9.5 | 1.2 Nylon 13–14 |
| | 1.3 Cellulose Nitrate 10 –11 | 1.3 diphenyl methane 9.6 | 1.3 Poly(ethylene) 7–8 |
| | 1.4 Poly(methyl methacrylate) 9–10 | 1.4 1-methyl naphthalene 9.9 | |
| | | 1.5 dibutyl phthalate 9.8 | |
| | | 1.6 dibromobenzene 10.3 | |
| Poly(isoprene) 8–9 | | | |
| (Ir309, Shell Chem. Co.) | (Same Ink Polymers as 1.1 thru 1.4) | (Same Ink Solvents as 1.1 thru 1.6 | (Same Image materials as 1.1 thru 1.3) |
| MEDIUM SOLUBILITY PARAMETER | | | |
| 2. Poly(vinyl butyral 9–10 (XYHL, 325, Union Carbide) | 2.1 Benzyl Cellulose 11–12 | 2.1 tetrahydronaphthalene 9.5 | 2.1 Poly(vinyl alcohol) 12–13 |
| | 2.2 Poly(vinylidene chloride 12–13 | 2.2 decanol 10.0 | 2.2 Nylon 13–14 |
| | 2.3 Same materials from 1.1 thru 1.4 | 2.3 diglycol diacetate 10.4 | 2.3 poly(ethylene)7–8 |
| | | 2.4 carbitol 10.3 | |
| | | 2.5 acetophenone 10.6 | |
| | | 2.6 methyl cellosolve 10.9 | |
| HIGH SOLUBILITY PARAMETER | | | |
| 3. Poly(vinyl alcohol) 12–13 | 3.1 Cellulose 15–16 | 3.1 Water 23 | 3.1 Poly(acrylonitrile) 12–13 |
| (Elvanol 70-05,Dupont) | 3.2 Cellulose acetate 13–14 | | 3.2 Nylon 13–14 |
| | 3.3 Poly(vinylpyrrolidone) (est.13–14) | | 3.3 Poly(ethylene) 7–8 |

Although the above criteria are sufficient for describing adhesion and release, provided the rheological properties of the ink approximate those of commercial lithographic inks, there are other factors which must be taken into account in selecting practical printing systems. Some of the practical considerations are crystallinity, oxidative stability, chemical inertness and volatility. Crystalline polymers would not be soluble in solvents of appropriate solubility parameters. When there is little oxidative stability the ink would have a poor shelf life, and the master would have limited reuse capability. For example, low oxidative stability is common for unsaturated aliphatic hydrocarbons and heteroatom functionalized hydrocarbons (amines, alcohols and some ethers). Further, there should not be any kind of chemical reaction occurring when the master and ink come in contact. Accordingly, examples of preferred solvents are the saturated aliphatic or aromatic hydrocarbons in a low solubilty parameter range of 8–10; the aliphatic alcohols in a medium solubility parameter range of 10–12; and water at a high solubility parameter.

Suitable substrates for the lithographic masters of the invention can be made from any suitable self-supporting material. Exemplary of suitable substrates are paper, metals such as aluminum and plastics such as polyester, polycarbonate, nylon and polyurethane. The only functional requirement for the substrate is that it be adherable to the swellable elastomeric layer as well as possess sufficient thermal and mechanical stability to permit use under varying printing and handling conditions.

The master non-imaged layer which is applied to the substrate can be any elastomeric polymer having an organohydrocarbon backbone, which may or may not contain heteroatoms, copolymer or mixture, which are wettable by the ink solvent and nonsoluble in the ink solvent but swellable by the ink solvent.

Exemplary of suitable materials are the following polymers and copolymers when they are crosslinked to an extent to render them insoluble in the ink solvent but swellable by it: the methyl, ethyl, propyl, and isobornyl ester of poly(acrylic acid); poly(vinyl butyral), poly(ethylene ethylphosphate), poly(1,3-propylene ethylphosphate), polybutadiene, poly(butadiene-co-acrylonitrile), poly(ethylene-co-propylene), poly(butadiene-co-styrene), poly(butadiene-co-vinylpyridine), polychloroprene, polyisobutene, poly(isobutene-co-isoprene), butyl rubber, polyisoprene, the butyl, ethyl, stearyl, and ethoxyethyl esters of poly(methacrylic acid); poly(ethylene sulfide), poly(vinyl bromide), poly(vinylidene fluoride-co-hexafluoropropylene); poly(vinylidene chloride), poly(vinyl chloride) and their copolymers, terpolymers, block copolymers, graft copolymers, and mixtures, and many other organohydrocarbon backbone polymers.

Conventional crosslinking agents can be employed for the aforesaid polymers. For example, fluorocarbon polymers can be crosslinked with the diamines such as hexamethylenediamine. Polymers with pendant hydroxyl groups such as poly(vinyl alcohol) can be crosslinked with a diisocyanate such as toluene diisocyanate. Saturated hydrocarbon polymers such as poly(ethylene-co-propylene) are crosslinked by using a terpolymer derivative. The added termonomer is generally a small amount of a diene (e.g. 1,4-hexadiene), the resulting pendant vinyl groups of which can be crosslinked with peroxide catalysts. Most of the other polymers can be crosslinked with peroxides such as benzoyl peroxide and dicumyl peroxide. The polymers are crosslinked to maintain and optimize mechanical and swelling properties and to render the polymer insoluble in the ink solvent. Generally the crosslinking agent is included in the solution of polymer obtained from the manufacturer. The polymers can be crosslinked by heat, using appropriate methods for exclusion of oxygen or water depending on the crosslink reaction, such as for example, by conducting the reaction under reduced pressure or under a cover sheet such as Mylar, Tedlar or polysulfone. The amount of crosslinking required will depend upon the particular polymer, the solvent and ink employed and can be easily determined by experiment. Generally, the master polymer should be swellable by the solvent employed from 10 to about 200 percent when the polymer is suspended in the solvent for 1 hour.

The polymer adapted to form the ink releasing non-imaged areas of the master should generally be amorphous or non-crystalline because they are swellable by the commonly employed solvents. Crystalline materials such as nylon and polyacrylonitrile are generally not suitable because they are swelled only by solvents which are not suitable for printing.

The master non-imaged layer can be applied to the substrate in a conventional manner such as by solvent casting or dip coating of the substrate in a solution of polymer, crosslinking agent, and organic solvent such as benzene, hexane, heptane, tetrahydrofuran, toluene, and xylene. Then the coating can be permitted to dry at ambient conditions to remove residual traces of solvent. Then the coatings are cured, usually by heat.

The thickness of the master non-imaged layer will vary depending on the material, its flexibility and the particular mechanical properties desired. Typically, however, it will have a thickness of between about 1 to 100 microns and preferably between about 2 to 25 microns.

The choice of swellable solvent to be employed will depend upon the particular polymer employed to form the non-imaged areas of the masters, the ink polymer as well as the toner used to form the ink accepting image. The solvent should have an ambient vapor pressure at 25° C of less than about 0.5 torr and preferably less than about0.3 torr. Further, the boiling point of the solvent should be above about 180° C and preferbly above about 200° C.

Preferred solvents for the printing masters of low solubility parameters are those solvents having non-polar forces such as the saturated hydrocarbons of high molecular weight such as between about 132 and 282, whether linear or branched, providing that the solubility parameter is within the proper range. The preferred solvents for the printing masters of medium solubility parameters are those solvents having polar forces (dipole-dipole, dipole-induced dipole, induced dipole-induced dipole) such as ester, ethers and long chain alcohols (e.g. 8–15 carbon atoms) of boiling points greater than 180° C and preferably greater than 200° C, providing that the solubility parameter is within the proper range. The preferred solvents for the printing masters of high solubility parameter are those solvents having very polar and/or hydrogen bonding forces such as organic acids, amines, alcohols such as glycols and triols and carbonates of boiling points greater than about 100° C and preferably greater than 200° C, provided that the solubility parameter is within the proper range.

Solvents with suitable solubility parameters can be selected from a series of tables of K. L. Hoy, previously incorporated by reference herein.

Exemplary of suitable solvents for masters of medium solubility parameters are the polar solvents such as: aliphatic alcohols, e.g., decanol; aliphatic esters, e.g., diglycol diacetate; aliphatic ether-alcohols, e.g., methyl cellosolve; and aliphatic ketones such as acetophenone.

Exemplary of suitable solvents for masters of high solubility parameters are the very polar or hydrogen bonding solvents such as water and aromatic and aliphatic alcohols such as phenol, propylene glycol, ethylene glycol and glycerol.

Exemplary of suitable solvents for low solubility parameter masters are the polysiloxane oils such as dimethyl siloxane oil available from Dow Corning Corporation as DC-200 (with typical viscosities between 5 and 200 centipoises) and an alkyl aryl polysiloxane oil available from Dow Corning Corporation as DC-230. Suitable aliphatic hydrocarbon oils are found in many lithographic inks, and in a preferred embodiment of the invention these oils are supplied to the master by inking with a "conventional lithographic ink", containing an appropriate ink resin and solvent. Other lithographic ink vehicles comprise polysiloxane oils such as polydimethylsiloxane, fatty acids and esters and other oleo components. Thus, with the use of these inks one can obtain a continuous application of the ink vehicle to the master although it may be necessary to add more oil to the ink in order to provide an amount sufficient to swell the non-imaged areas of the master. Generally, from between about 20 to about 40 percent oil, based upon the weight of the lithographic ink, is found to be sufficient.

Although it is preferred to add the solvent to the ink, the solvent can be added separately to the master. Further, a mixture of solvents can be employed in the ink, in the master, in individually or in any combination.

Commercially available lithographic inks can be employed to print with the masters in accordance with the process of the invention provided the ink resin (polymer) and solvent have the right solubility parameters. The particular ink employed will be dependent upon the solubility and adhesion properties of the particulate image pattern and the master, and the degree to which they are wetted by the ink of choice. Typical inks for low solubilty parameter masters include rubber based inks as well as those of the type which have the vehicle component for the ink derived from various materials such as aromatic and aliphatic hydrocarbons, vegetables oils, poly(alykleneyglycols), dry oil varnishes, lacquers and liquid resins.

Typical inks for masters of medium solubility parameters contain solvents of medium solubility parameters such as dodecanol, tetrahydronaphthalene, carbitol, methyl cellosolve; and resins (polymers) of higher solubility parameters such as benzyl cellulose, poly(methyl acrylate) and poly(vinylidene chloride). Typical inks for high solubility parameters masters contain solvents of high solubility parameter such as water and aliphatic or aromatic alcohols such as propylene glycol and phenol; carbonates such as propylene carbonate, amines such as pyridine; and polymers having high solubility parameters such as poly(vinyl pyrrolidone), cellulose acetate, cellulose and poly(acrylamide).

Conventional electrophotographic methods of imaging can be employed such as xerography, electrography, electrophoretic imaging, migration imaging and manifold imaging. Alternative imaging methods can employ the use of laser, electron beam, plasma beam, etc., which provide favorable chemical changes in the image areas as well as favorable structural changes (surface roughening), or they can be employed to etch away the master surface layer to expose the substrate.

As an example of the many imaging methods, xerography is illustrative. The basic xerographic process involves depositing a uniform electrostatic charge on a photoconductive insulating layer exposing the layer to a light and shadow image to dissipate the charge on the areas of the layers exposed to the light, and developing the resulting electrostatic latent image by depositing on the image a finely divided electroscopic imaging material referred to in the art as toner. The toner will normally be attracted to those areas of the layer which retain a charge thereby forming a toner image corresponding to the electrostatic latent image. This powder image may then be transferred to a receiving surface such as the master or an intermediate surface such as paper, and the image then transferred to the master. The transferred image may subsequently be permanently affixed to the receiving master surface by fusing with heat or vapor.

As an alternative embodiment, a photoresist such as Kodak photoresist can be coated on the elastomeric layer, the composite exposed to activating electromagnetic radiation in imagewise configuration and the unexposed background areas removed. As a further alternative, a light-sensitive diazo resin characterized as being water soluble in its light-sensitive state and becoming water insoluble in its light-exposed stated, can be coated on an ink accepting substrate. Then an elastomeric ink reasing layer can be overcoated thereon and the composite exposed to activating electromagnetic radiation. The light sensitive coating and the ink releasing elastomeric coating overlying said light sensitive coating can then be readily removed upon lightly rubbing the plate with a cloth containing a solvent, to bare the underlying ink accepting substrate in the image light struck areas. This method of imaging is disclosed by Curtin, in U.S. Pat. No. 3,511,178, in connection with a dry lithographic process based on silicone elastomer coatings.

While the image can be formed on the master by conventional means, the preferred method is to form the image by electrostatographic techniques such as xerography and develop the image with a particulate material referred to in the art as toner. The image can be formed and developed on a separate photoconductive substrate and transferred to the printing master or a photoconductive substance such as triphenyl amine, phthalocyanine, trigonal selenium, the like can be diffused in relatively small volumes into the printing master binder to permit direct imaging and development (typically 5–50 volume percent of p/c (photoconductor) in binder may be used to good advantage). The toner employed will depend upon the particular polymer employed as the non-imaged portions of the master as well as the swellable solvent employed. Typical toners are thermoplastic hydrocarbon polymers such as polyethylene and polymers of styrene such as polystyrene, poly($\alpha$-methylstyrene) and the like. Crystalline materials such as nylon, polyethylene and polyacrylonitrile are preferred.

The following examples will serve to illustrate the invention and preferred embodiments thereof. All parts and percentages in said examples and elsewhere in the specification and claims are by weight unless otherwise specified.

EXAMPLE I

Preparation of Master

A solution containing 6.6 grams [poly(ethylene-co-propylene)] Nordel 1470 (DuPont) and 2.3 grams of 1,1-bis (t-butyl peroxy)-3,3,5-trimethyl cyclohexane) in 100 grams of hexane was cast on grained aluminum (0.006 inch thick) using a blade coater with a 0.008 inch aperture. The film was air dried for 1 hour, covered with a suitable Mylar cover sheet and placed in a vacuum oven (0.5 torr) at 140° C for 2 hours. A $1\frac{1}{2} \times 2$ inch section was suspended in dodecane for 1 hour, and the percent swelling was determined to be an increase in weight of 121–126% based on polymer dry weight.

IMAGING

Three masters prepared by the above procedure were imaged employing a Xerox Model D Processor and three different conventional toners. The toners used were Xerox 2400 toner, (comprising a copolymer of styrene and butyl methacrylate), poly($\alpha$-methylstyrene) toner, and unpigmented polyethylene. Of these, polyethylene gave the best adhesion to the Nordel 1470 master surface. The toner image was electrostatically transferred from a selenium flat plate to a paper sheet and from there to the crosslinked Nordel 1470 master surface. The toner was then heat fused (15–90 seconds at 150°) to the master surface.

Printing

The master was placed on a conventional lithographic printing press (Davidson 560, or A. B. Dick 325B) from which the water fountain had been removed. A commercially available rubber-based printing ink (Van Son 10850 or Ronico XL91799) was employed and acceptable copies were obtained by printing in a direct or in an offset mode. These commercially available inks have a $\delta$(ink polymer)$\sim$9–10(cal/cm$^3$)$^{\frac{1}{2}}$ and $\delta$(ink solvent $\sim$8(cal/cm$^3$)$^{\frac{1}{2}}$.

EXAMPLE II

In accordance with the general procedure of Example I, masters were made of thin films (5–20 $\mu$ thick) of polyisoprene. The casting solution consisted of 2 grams of polyisoprene, 0.1 gram zinc oxide, 0.04 gram sulfur, 0.02 gram stearic acid, 0.01 gram tetramethylthiuram disulfide and 38 grams hexane. Films were fitted with a cover sheet, cured at 157° C and then imaged employing Xerox 2400 toner. Fair prints were obtained by hand inking and transfer employing Van Son 10850 ink without any fountain solution.

EXAMPLE III

In accordance with the general procedure of Example I, masters were made of thin films (5–20 $\mu$ thick) of poly(vinyl alcohol). The casting solution contained 0.35 grams poly(vinyl alcohol, 13.5 ml water and 1–2 drops $VOCl_2$. The film was allowed to dry at ambient temperature for 18 hours and heated for 5–10 seconds at 150° C. Copies of fair contrast were obtained while hand printing employing an ink mixture of 55.4 grams of [poly(propylene glycol) MW 2025], 40 grams of carbon black and 8.6 grams of water. It was necessary to add a few drops of water to either the master or the ink to obtain ink release. This would permit excess water to increase diffusion rates as well as replace any water deficiency in the ink due to its evaporation (diffusion) from the ink.

EXAMPLES IV–V

Employing the general procedure of Example I, a poly(dimethyl siloxane) elastomer gum (Union Carbide Y-3557) not encompassed within the invention was crosslinked with the acetone oxime adduct of toluene 2,4-diisocyanate at 125° C through the pendant aminobutyl groups of the gum. The plate was imaged with Xerox 2400 toner and prints made employing Lewis and Roberts X8931 water base ink and Pope and Gray Astro Green G-10579. During the press run, it was found that there was little (less than 1 percent) diffusion of solvent into the master.

An identical imaged master plate was prepared and prints were obtained using Van Son 10850 and Ronico XL91779 inks. On the first pass of the inking roller, limited or no ink release occurred and there was limited or no solvent diffusion. Good to excellent ink release from the non-image areas was found only after sufficient solvent swelling (approximately 6–10 percent) or after a sufficient number of ink roller passes (2–10 passes). After extended printing, the solvents from these inks swelled the non-imaged areas of the masters' surfaces approximately 28–32 percent. Good to excellent prints having ink reflection density of about 0.06 were obtained with these inks.

The solubility parameters of the ink resin and ink solvents both are high for the aforesaid water based inks (X8931 and G-10579) and they do not properly match the solubility parameter of the poly(dimethylsiloxane) non-image surface. Therefore, there is not sufficient solvent diffusion so that only prints of poor contrast are obtained. The aforesaid rubber-based inks, Van Son 10850 and Ronico XL91779, however, have solubility parameters for the ink resins and ink solvents which properly match the solubilty parameter of the poly(-dimethylsiloxane) non-image surface so that diffusion occurs and good to excellent prints are obtained.

EXAMPLE VI

In accordance with the general procedure of Example I, masters were made of thin films (est. 14–16 $\mu$) of polyurethane materials [Indpol Monothane E-30 and Monothane E-70 (30 and 70 durometer, respectively)]. The toluene casting solution contained 25–50% of the polyurethane material. The curing agent was incorporated by the manufacturer. The curing conditions were 3 hours at 132° C after air drying to remove the casting solvent. Ink release with Van Son 10850 or Ronico XL91779 ink did not take place even though these materials swelled in the presence of the ink.

| Material | % Swelling with Van Son 10850 | Contact Time | % Swelling with Ronico XL91779 | Contact Time |
|---|---|---|---|---|
| Monothane E-30 | 22.8 | 18 hr. | — | — |
| Monothane E-70 | 20.4 | 18.5 hr. | 17.4 | 17 hr. |

The solubility parameter of polyurethane materials is high [$\delta\sim$12–13(cal/cm$^3$)$^{\frac{1}{2}}$] and does not properly match the solubility parameters of the ink components. Therefore, ink release is not obtained since the difference between the solubility parameter of the ink polymer [$\delta\sim$9–10(cal/cm$^3$)$^{\frac{1}{2}}$] and the solubility parameter of the background [$\delta\sim$7–8(cal/cm$^3$)$^{\frac{1}{2}}$] is not larger than the difference between the solubility parameter of the ink solvent [$\delta \sim 8(cal/cm^3)^{\frac{1}{2}}$] and the solubility parameter of the background.

EXAMPLE VII

A flat strip of Teflon (Temp-R-Tape) (a low surface energy material having a calculated solubility parameter of 6–7$(cal/cm^3)^{\frac{1}{2}}$) can be readily inked with several commercially available inks (e.g. Van Son 10850) when inked with a hand inking roller or under normal printing press conditions. At linear speeds of 0.2 inches per second to 50 inches per second of the inking roller the ink adhered to the Teflon surface on every pass of the inking roller. These ink solvents do not swell the Teflon material due to its crystallinity even though the solubility parameters of the solvents are near the solubility parameter of the Teflon. Therefore, this material should ink since swelling is a requirement for the release of inks having viscoelastic properties comparable to that of commercially available lithographic inks.

Having described the present invention with reference to these specific embodiments, it is to be understood that numerous variations may be made without departing from the spirit of the present invention and it is intended to encompass such reasonable variations or equivalents within its scope.

What is claimed is:

1. A process for printing comprising applying an ink and a non-aqueous solvent to an imaged master and transferring the resultant developed image to a receiver member wherein the master comprises a suitable non-metal master substrate and a non-imaged contiguous surface layer of an elastomeric non-aqueous solvent swellable, crosslinked polymer, copolymer or mixture of polymers, said polymer, copolymer or mixture of polymers having an essentially hydrocarbon backbone which may contain heteroatoms selected from nitrogen, phosphorus, oxygen, sulfur, bromine, fluorine and chlorine with the halogen atoms only in a side chain; said solvent being capable of swelling the nonimaged areas of said elastomer but not capable of dissolving, diffusing into, or remaining on the imaged areas and wherein the solvent is added in an amount to diffuse into the non-imaged areas of said imaged master and form a substantially ink-free layer on the non-imaged areas of the master during inking and transferring of the inked image.

2. The process of claim 1 wherein the non-imaged areas are formed by a layer of a solvent swellable cross-linked polymer consisting essentially of ethylene-propylene copolymer.

3. The process of claim 1 wherein the non-imaged areas are formed by a layer of a solvent swellable cross-linked polymer consisting essentially of poly(vinyl alcohol).

4. The process of claim 1 wherein the non-imaged areas are formed by a layer of a solvent swellable cross-linked polymer consisting essentially of poly(vinyl butyral).

5. The process of claim 1 wherein the non-imaged areas are formed by a layer of a solvent swellable cross-linked polymer consisting essentially of polyisoprene.

6. The process of claim 1 wherein the imaged areas are formed of a thermoplastic polymer.

7. The process of claim 1 wherein the imaged areas comprise a polymer selected from polyethylene, poly(acrylonitrile) and nylon.

8. The process of claim 1 wherein the solvent is poly(dimethylsiloxane).

9. A process for printing comprising inking an imaged master and transferring the resultant developed image to a receiver member wherein the master comprises a suitable non-metal master substrate and a non-imaged contiguous surface layer of an elastomeric non-aqueous solvent swellable, cross-linked polymer, copolymer or mixture of polymers, said polymer, copolymer or mixture of polymers having an essentially hydrocarbon backbone which may contain heteroatoms selected from nitrogen, phosphorus, oxygen, sulfur, bromine, fluorine and chlorine with the halogen atoms only in a side chain; the ink employed comprises an ink polymer, a pigment and a solvent, said ink polymer is soluble in said solvent and said solvent is capable of swelling the non-imaged areas of said elastomeric imaged master, but not capable of dissolving, diffusing into or remaining on the imaged areas and wherein the solvent diffuses into the non-imaged areas in an amount sufficient to form a substantially pigment-free layer in the non-imaged areas of the master during inking and transferring of the inked image so that only the imaged areas of the master are inked with the pigment.

10. The process of claim 9 wherein the solvent swellable crosslinked polymer is selected from ethylene-propylene copolymer, polybutadiene, polyisobutene, chloroprene chlorinated rubber, natural rubber, neoprene, copolymers and mixtures having a solubility parameter between about 10 and about 12.

11. The process of claim 9 wherein the solvent swellable crosslinked polymer consists essentially of poly(vinyl alcohol).

12. The process of claim 9 wherein the solvent swellable crosslinked polymer consists essentially of poly (vinyl butyral).

13. The process of claim 9 wherein the solvent swellable crosslinked polymer consists essentially of polyisoprene.

14. The process of claim 9 wherein the imaged areas are formed of a thermoplastic polymer.

15. The process of claim 9 wherein the imaged areas comprise a polymer selected from polyethylene, poly(acrylonitrile), and nylon.

16. The process of claim 1 wherein the solvent is selected from organopolysiloxane oils, aromatic and saturated aliphatic hydrocarbons and mixtures having a solubility parameter of between about 8 and about 10.

17. The process of claim 9 wherein the solvent is selected from organopolysiloxane oils, aromatic and saturated aliphatic hydrocarbons and mixtures having a solubility parameter of between about 8 and about 10.

18. The process of claim 9 wherein the solvent is selected from aliphatic alcohols, aliphatic ether-alcohols and aliphatic ketones having a solubility parameter between about 10 and about 12.

19. The process of claim 1 wherein the solvent is selected from aliphatic alcohols, aliphatic ether-alcohols and aliphatic ketones having a solubility parameter between about 10 and 12.

20. The process of claim 9 wherein the solvent comprises polydimethylsiloxane oil.

21. The process of claim 9 wherein the solvent is a saturated aliphatic hydrocarbon.

* * * * *